United States Patent [19]

Kishi et al.

[11] Patent Number: 4,997,614

[45] Date of Patent: Mar. 5, 1991

[54] METHOD OF MIXING RAW MATERIAL COMPOSITION OF HIGHLY IGNITABLE OR EXPLOSIVE MATERIAL

[75] Inventors: Kazuo Kishi, Kanagawa; Jun Kato, Tokyo, both of Japan

[73] Assignee: Daicel Chemical Industries, Ltd., Sakai, Japan

[21] Appl. No.: 438,589

[22] Filed: Nov. 17, 1989

[51] Int. Cl.[5] ..... C06B 21/00

[52] U.S. Cl. ..... 264/3.2; 264/3.4; 264/3.6

[58] Field of Search ..... 264/3.2, 3.4, 3.6

[56] References Cited

U.S. PATENT DOCUMENTS

| | | | |
|---|---|---|---|
| 2,874,604 | 2/1959 | Diels et al. | 86/1 |
| 3,928,514 | 12/1975 | Brachert et al. | 264/3.2 |
| 4,326,901 | 4/1982 | Leneven et al. | 264/3.2 |
| 4,376,083 | 3/1983 | Ulsteen | 264/3.4 |
| 4,428,786 | 1/1984 | Arni | 264/3.1 |

*Primary Examiner*—Peter A. Nelson

*Attorney, Agent, or Firm*—Flynn, Thiel, Boutell & Tanis

[57] ABSTRACT

A raw material composition for igniters, etc. which may ignite or explode can be safely mixed with high homogeneity by dissolving or dispersing a raw material composition of a highly ignitable or explosive material in a solvent or a dispersion medium, applying the resultant dispersion on a heated plate to form a thin film, and drying said thin film.

10 Claims, 1 Drawing Sheet

METHOD OF MIXING RAW MATERIAL COMPOSITION OF HIGHLY IGNITABLE OR EXPLOSIVE MATERIAL

BACKGROUND OF THE INVENTION

The present invention relates to a method of mixing a raw material composition used in the preparation of materials which may ignite or explode, such as igniters, and, more particularly, to a method of mixing a raw material composition for igniters, etc. which enables the mixing of the raw material composition to be conducted in a safe manner with high homogeneity.

Great care should be taken in handling igniters, etc. because they evolve a large amount of a high-temperature gas due to a rapid redox reaction. The igniters, etc. have hitherto been prepared by homogeneously mixing a raw material composition comprising a finely divided metal powder or a reducing salt, such as azide, and a metal oxide, such as copper oxide or lead oxide, or an oxidizing salt, such as a salt of nitric acid or a salt of perchloric acid; and molding the resultant mixture by pressure molding etc. into a pellet having a suitable shape.

It is known that an excessively large particle diameter of the raw material composition and insufficient mixing in the above-described step of mixing hinder the progress of an intended redox reaction during the use of the product, which brings about variation in combustivility, particularly variation in the burning velocity of the pellet, so that it becomes difficult to evolve a high-temperature and high-pressure gas in a predetermined time. For this reason, in a generally adopted method, individual raw material ingredients are ground into fine particles of the order of a few microns or less and then sufficiently mixed.

However, once such a mixture comprising fine particles is ignited, it brings about such violent burning or deflagration that handling thereof involves great danger. This makes it necessary to limit the amount of each ingredient to be mixed in one run to a small amount , which has led to a problem of low productivity. Further, remote control of the operation through a blast wall is necessary for the purpose of securing safety, which necessitates unfavorable expenses for facilities therefor.

Meanwhile, a known, safer mixing method in preparing the above-described raw material composition comprises adding a low-boiling point liquid, such as methanol or ethanol, which does not dissolve any of the ingredients, mixing the ingredients, and removing the liquid by heating or the like. However, this method has a drawback that the process becomes very complicated.

In a rapid dehydration and crystallization method proposed by the present inventor in Japanese Pat. Laid-Open No. 1077/1978 in connection with a gas generating agent comprising two or more water-soluble salts, such as niter and sodium azide, wherein water-soluble organic solvents, such as methanol, ethanol or acetone, are used . An aqueous solution of two or more salts in a high concentration at 50° to 60° C. or above are poured with sufficient stirring, into a water-soluble organic solvent, such as methanol, ethanol, isopropanol or acetone, of an amount at least 20 to 30 times as large as the aqueous solution is cooled to about 0° C. or below. It is necessary to provide a step of collecting precipitates by filtration and drying and a step of recovering the solvent by distillation, etc., which renders the procedures so complicated that this method is economically impractical

SUMMARY OF THE INVENTION

Accordingly, an object of the present invention is to provide a method of mixing a raw material composition of a highly ignitable or explosive material in a very safe manner with high homogeneity.

The present inventors have made intensive studies with a view to eliminating the above-described problems and, as a result, succeeded in developing a mixing method which enables the preparation of a homogeneous mixture in a very safe operation by adopting a continuous process comprising, in the following order, wet mixing by dispersion or dissolution, application, and drying.

Accordingly, the present invention provides a method of mixing a raw material composition of a highly ignitable or explosive material, characterized by dissolving or dispersing a raw material composition of a highly ignitable or explosive material in a solvent or a dispersion medium, applying the resultant dispersion on a heated plate to form a thin film, and drying said thin film.

DESCRIPTION OF THE PREFERRED EMBODIMENTS

Figure 1:
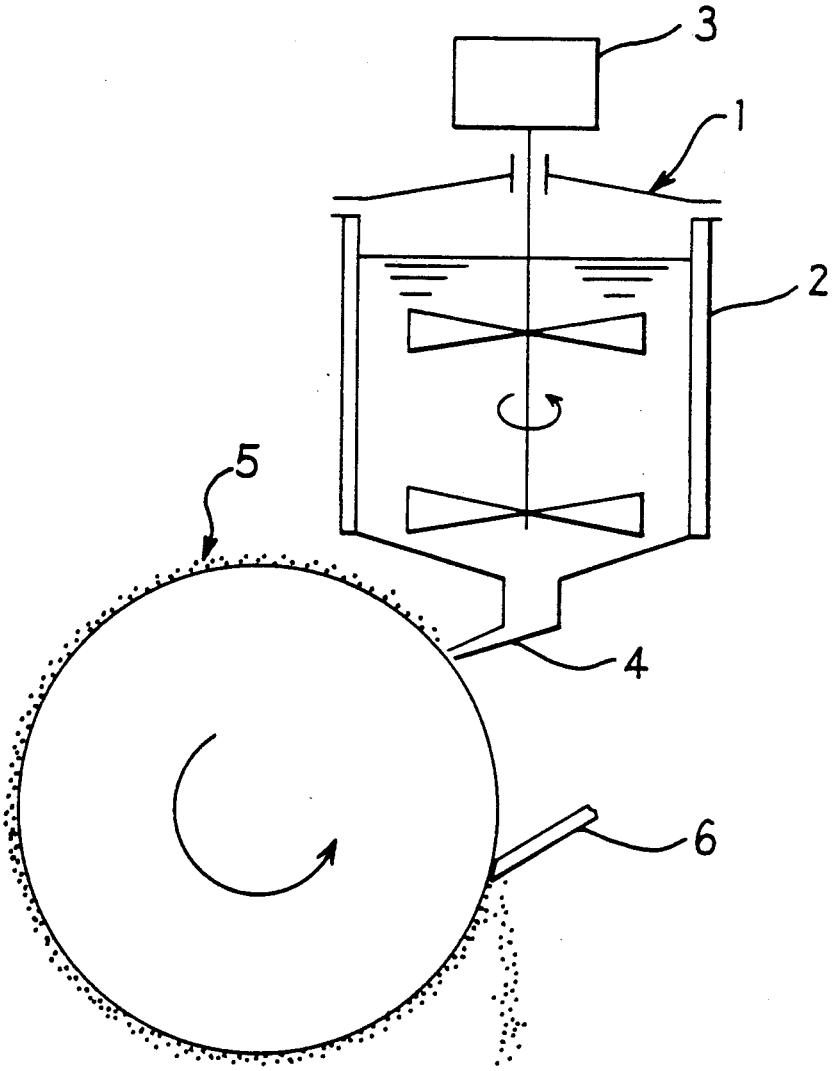
FIG. 1 is a vertical sectional view of a specific example of an apparatus used in the mixing method of the present invention.

The raw material composition used in the mixing method of the present invention is a raw material composition of an igniter which is highly ignitable or explosive, and examples thereof include a raw material composition comprising finely divided metal powder, such as magnesium, or a reducing salt, such as azide, and a metal oxide, such as copper oxide or lead oxide, or an oxidizing salt, such as a salt of nitric acid or a salt of perchloric acid, The method of the present invention is very useful not only for the above-described composition but also for a dangerous raw material which must be mixed with due care or a raw material composition which must be homogenously mixed.

Inorganic or organic solvents having a relatively low boiling point may be arbitrarily used as the solvent or dispersion medium for dissolving or dispersing the above-described raw material compositon, depending upon the purposes of use. For example, water is safest against ignition and advantageous also from the viewpoint of economy. Further, in the mixing of a composition comprising two or more water-soluble salts, water can bring about an excellent mixing state. On the other hand, in order to mix an organic substance with an inorganic salt powder, an organic solvent is suitable.

According to the present invention, a solution or a dispersion containing the above-described raw material composition dissolved or dispersed therein is applied on a heated plate. The heated plate is particularly preferably a rotating drum equipped with means for heating the drum from the inside thereof with electric power, hot water, steam, etc. In this case, the rotation of the drum promotes the evaporation of the solvent or dispersion medium. Alternatively, if necessary , heated air or an inert gas may be blown against the heated plate, or the heating section may be evacuated to conduct drying at a low temperature for the purpose of improving the safety.

FIG. 1 is a cross-sectional view of a specific example of the apparatus used in the mixing method according to the present invention.

The apparatus shown in FIG. 1 mainly comprises a cylindrical dissolver 1, a rotating drum 5 provided with heating means in the side thereof, and a scraper 6. The drum 5 is disposed near and below the dissolver 1 in such a manner that the shaft of the drum is horizontal. The scraper 6 is disposed below the dissolver 1 and in contact with the surface of the drum 5. An agitator 3, equipped with a propeller shaft on the central axis thereof, is provided at the upper part of the dissolver 1, and a heating jacket 2, for adjusting the temperature of the liquid within the dissolver, is provided in such a manner that it is wound around the side of the dissolver 1. An outlet 4 for discharging a solution or a dispersion is formed at the center of the botton of the dissolver 1. The outlet 4 is molded into a nozzle having a slender opening at its head portion, and the tip of the head protion is located near the drum surface.

in practicing the method of mixing of the present invention by making use of the above-described apparatus, a solvent or a dispersion medium is first poured into the dissolver 1, and the temperature of the medium is properly adjusted by the heating jacket 2 while agitating the medium with the agitator 3. Then, a predetermined oxidizing agent, reducing agent, and additives are added to the medium in the dissolver and dissolved or dispersed in the medium. Meanwhile, the rotating drum 5 is heated to a predetermined temperature and rotated. After the raw material composition in the dissolver has been completely dissolved or sufficiently dispersed, the solution is continuously poured onto the rotating drum 5 through the outlet 4.

In this case, the solution or dispersion is discharged through the outlet 4 provided on the lower part of the dissolver and applied in the form of a film corresponding to the shape of the nozzle on the surface of the rotating drum 5, and the solvent rapidly evaporates during the rotation of the heated rotating drum 5, whereby the dissolved or dispersed material is deposited and dried thereon.

The deposited material is carried to the scraper 6 by the rotation of the drum surface, scraped and separated therefrom and immediately transported to the subsequent step of treatment.

The diameter of the crystallized particle can be regulated by properly controlling the solution concentration, material, surface temperature and speed of revolution of the rotating drum 5. In particular, the surface temperature of the rotating drum 5 should be maintained at a temperature below the ignition temperature of the deposited material and is preferably set taking into consideration additional factors such as the frictional heat generated by the scraper 6.

[EXAMPLES ]

The present invention will now be described in more detail by way of Examples, though the present invention is not limited to these only.

EXAMPLE 1

The apparatus shown in FIG. 1 was used in this example and a dispersion prepared by dissolving and dispersing 15.0 parts of potassium perchlorate and 0.5 part of iron oxide in 100 parts of water at 100° C. was applied in a thin film and dried on the surface of a rotating roll having a surface temperature of 95° C. and continuously scraped therefrom to prepare a powder.

This powder was observed in a magnified state under a microscope. As a result, it was found that the powder comprised a homogeneous mixture of potassium perchlorate microcrystals having a particle diameter of about 1 micron with iron oxide.

EXAMPLE 2

The apparatus shown in FIG. 1 was used in this example, and a dispersion prepared by homogeneously dispersing 14.0 parts of the powder prepared in EXAMPLE 1 and 9.7 parts of metallic magnesium having a particle diameter of about 10 microns in 50 parts of acetone at room temperature was applied in a thin film and dried on the surface of a rotating roll having a surface temperature of 50° C. and continuously scraped therefrom to prepare a powder.

This powder comprised a homogeneous mixture of potassium perchlorate microcrystals having a particle diameter of about 1 micron with iron oxide and finely divided magensium powder.

EXAMPLE 3

The apparatus shown in FIG. 1 was used in this example and a solution prepared by dispersing and dissolving 42.0 parts of potassium chlorate, 28.0 parts of sugar, 30.0 parts of magnesium carbonate and 0.3 part of nitrocellulose, each in finely divided powder form , in 100 parts of acetone was applied to and dried on the surface of a rotating roll having a surface temperature of 50° C. and continuously scraped therefrom to prepare a powder.

This powder comprised a homogeneous mixture of finely divided powdery ingredients.

The mixing method of the present invention enables the mixing of a raw material composition to be very safely and simply conducted during the preparation of an igniter, etc. which may bring about the danger of ignition or explosion, and further is advantageous in an economical sense. Further, in the method present invention, since the raw material composition is subjected to a dissolution or dispersion treatment, it is possible to obtain a very homogeneous mixture.

What is claimed is:

1. A method of mixing a raw material composition of an easily ignitable or explosive material comprising the steps of dissolving or dispersing the raw material composition of the easily ignitable or explosive material in a solvent or a dispersion medium to form a resultant mixture; applying the resultant mixture to the outer surface of a rotating drum provided with means for heating said outer surface, forming a thin film of said resultant mixture thereon; drying the thin film on the outer surface of the rotating drum; and removing the raw material composition from the outer surface of the rotating drum.

2. The method of claim 3, wherein the raw material composition is removed from the outer surface of the rotating drum by scraping means.

3. The method of claim 1, additionally comprising the step of contacting the thin film of the resultant mixture on the outer surface of the rotating drum with heated air or an inert gas to aid in the drying of the thin film.

4. The method of claim 1, wherein the solvent or dispersion medium is water.

5. The method of claim 1, wherein the solvent or dispersion medium is an organic liquid.

6. The method of claim 1, wherein said raw material composition comprises potassium perchlorate and iron oxide.

7. The method of claim 6, wherein said raw material composition additionally comprises metallic magnesium.

8. the method of claim 1, wherein said raw material composition comprises potassium chlorate, sugar, magnesium carbonate and nitrocellulose.

9. The method of claim 1, wherein the outer surface of the rotating drum is maintained at a temperature lower than the ignition temperature of the raw material composition.

10. The method of claim 1, wherein said material composition is dissolved or dispersed in a vessel containing agitation means.

* * * * *

UNITED STATES PATENT AND TRADEMARK OFFICE

CERTIFICATE OF CORRECTION

PATENT NO. : 4 997 614

DATED : March 5, 1991

INVENTOR(S) : Kazuo KISHI et al

It is certified that error appears in the above-identified patent and that said Letters Patent is hereby corrected as shown below:

Column 4, line 58; change "claim 3" to ---claim 1---.

Column 6, line 1; change "the" to ---The---.

Signed and Sealed this

Fifteenth Day of September, 1992

*Attest:*

DOUGLAS B. COMER

*Attesting Officer*

*Acting Commissioner of Patents and Trademarks*